United States Patent [19]

Ried, Jr.

[11] 4,150,373

[45] Apr. 17, 1979

[54] IONIZATION PARTICLE DETECTOR

[76] Inventor: Louis Ried, Jr., 195 Pawnee Drive, Boulder, Colo. 80303

[21] Appl. No.: 763,011

[22] Filed: Jan. 27, 1977

[51] Int. Cl.[2] ..... G08B 17/10

[52] U.S. Cl. ..... 340/629; 250/381; 313/54

[58] Field of Search ..... 340/237.5, 628, 629; 250/381, 382, 384, 385, 389; 313/54

[56] References Cited

U.S. PATENT DOCUMENTS

| | | | |
|---|---|---|---|
| 2,537,028 | 1/1951 | Cahusec et al. | 340/237.5 |
| 3,018,376 | 1/1962 | Vanderschmidt | 250/384 |
| 3,514,603 | 5/1970 | Klein | 340/237.5 |
| 3,908,957 | 9/1975 | Schutt | 340/237.5 X |
| 3,935,466 | 1/1976 | Tomioka | 340/237.5 X |
| 4,012,729 | 3/1977 | Weaver et al. | 340/237.5 |

*Primary Examiner*—John W. Caldwell, Sr.
*Assistant Examiner*—Daniel Myer
*Attorney, Agent, or Firm*—O'Rourke & Harris

[57] ABSTRACT

An ionization particle detector for indicating the presence of charged particles in a gas includes a single ionization chamber having two defined regions of electrical field intensity. The first region is of small geometric volume and high electric field intensity while the second region is of large geometric volume and low electric field intensity. The radioactive source for generating the ions is located near one electrode while the second electrode forming the walls of the chamber are located such that the walls are incident near the Bragg ionization peak of the detector. A probe is positioned between the two regions for detecting the maximum electric field change when particles enter the chamber.

15 Claims, 25 Drawing Figures

IONIZATION PARTICLE DETECTOR

BACKGROUND OF THE INVENTION

1. Field of the Invention

The present invention relates generally to charged particle detectors and more particularly to single chamber ionization detectors applicable to combustion product and smoke detectors.

2. Background of the Prior Art

Ionization smoke detectors utilize a radioactive source to provide charged ions in a sensing chamber having an electric field. When the charged ions of the radioactive source are placed in an electric field, the positive ions migrate to the negative electrode of the field while the negative ions migrate to the corresponding positive electrode. The current generated by the emission of the ions from the source is extremely small, generally in the order of $10^{-11}$ amps. As the voltage across the electrical field in increased, there is a corresponding increase in the amount of current. However, a saturation current is reached at a specific voltage which is termed Saturation Voltage. Under normal conditions, the current is a function of the following factors: (1) ion mobility, (2) ion density per unit volume, (3) electric field intensity, (4) geometry of the chamber, and (5) the rate of source ion emissions (i.e. ions per unit volume per unit time).

A conventional smoke detector 100 operates, by reference to FIG. 1, as follows. The smoke detector 100 is mounted to the ceiling of room 110. When aerosols 120, generated by combustion of material 130 enter the chamber of detector 100, the aerosols 120 will deposit upon the ions. Generally, the aerosols are many thousand times larger than the emitted ions so that a marked decrease in the mobility of the combined ions and aerosols result in increased recombination (i.e. the combination or attraction of the negative ion with the position ion) so that the current is correspondingly reduced. Conventionally, the change in current is detected as a voltage by a field-effect transistor which in turn drives an alarm device. The best operation range for the current flowing in the electric field is at a voltage that is substantially mid-range between the saturation current and zero current. This range is most sensitive to the presence of aerosols.

A discussion of commercially available ionization-type smoke detectors is found in the October, 1976 issue of *Consumer Reports*, pgs. 555–559.

Some prior art smoke detectors use only a single inoization chamber. A single ionization chamber device is shown in FIG. 2 to comprise a battery 200 connected in series with resistor 202 and the ionization chamber 204. A field-effect transistor 206 is interconnected across the resistor 202 and chamber 204 so that the gate of the field-effect transistor 206 is connected between the chamber 204 and the resistor 202, and the source and drain of the transistor 206 are connected across battery 200. An output voltage $E_0$ is generated across resistor 208 which is interconnected between the drain and the negative side of the battery 200. In FIG. 3 the output 300 generated at $E_0$ is shown before and after smoke entry in the chamber 204. Curve 300 is the output characteristic of the ionization chamber with no smoke while curve 302 is the output characteristic when smoke is present. Curve 304 represents the I-V characteristic for resistor 202. The disadvantages with the single chamber approach is that the resistor 202 is large being about $10^{11}$ ohms, is expensive to manufacture and is subject to leakage through contamination. Furthermore, variations in the radioactive source 210 located with chamber 204 causes variation in operating point and as a result sensitivity in chamber operation. Furthermore, if used, the sampling circuitry is complex and costly. Also, resistor 202 does not compensate for changes in humidity, air pressure, and temperature. Finally, calibration in adjustment is difficult since the sensitivity and stability is directly affected by source contamination such as dirt, etc. in the direction of the alarm. A prior art patent disclosing a single chamber device has been issued to McMillin et al, Mar. 23, 1976 as U.S. Pat. No. 3,946,374.

A second type of ionization smoke detector uses two ionization chambers, one example being shown in FIG. 4. A battery 400 is connected in parallel across the dual chamber configuration 402. The upper chamber 404 is termed the "Reference Chamber" and that chamber is in a saturated current condition. The second chamber 406 is termed the "Sensing Chamber" and is in the unsaturated condition at the optimum operating point as previously discussed. The field-effect transistor 408 has its gate interconnected at the juncture 410 between the two chambers 404 and 406. A voltage $E_0$ is developed across resistor 412. The operating characteristics for the two chamber detector is shown in FIG. 5. The Reference Chamber 404 with output curve 500 is shown to be in saturation condition while the Sensing Chamber 406 with output curve 510 is shown to be at the optimum operating point 520. When smoke enters chamber 406, the output voltage $E_0$ drops to the curve 530. The signal voltage is shown as $\Delta V$. The use of the two chambers 404 and 406 eliminates many of the problems associated with the single chamber described above. Unfortunately, two radioactive sources are now required with the result being a significantly higher manufacturing cost. Furthermore, the two radioactive sources must be matched since if a mismatch results, difficulty in adjustments and calibration occurs. Dust or chemical contaminants on either source can also cause an increase or decrease in sensitivity, depending upon which source is contaminated.

The following prior art U.S. Pat. Nos. represent variations of smoke detectors using two ionization chambers:

Lambert 3,710,110 Jan. 9, 1973
Scheidweiler 3,714,614 Jan. 30, 1973
Lehsten 3,903,419 Sept. 2, 1975
Scheidweiler et al 3,909,813 Sept. 30, 1975
Eguchi 3,909,814 Sept. 30, 1975
Emerson et al 3,952,294 Apr. 20, 1976
Tipton et al 3,959,788 May 25, 1976
Adachi et al 3,964,036 June 15, 1976

Other types of smoke detector prior art devices are disclosed in the following U.S. Pat. Nos.

Lecuier 3,922,655 Nov. 25, 1975
Horvath et al 3,922,656 Nov. 25, 1975
Hurd 3,930,247 Dec. 30, 1975
Muller-Girard et al 3,936,814 Feb. 3,1976
Gacoby 3,938,115 Feb. 11, 1976
Rayl et al 3,949,390 Apr. 6, 1976
Campman 3,950,739 Apr. 13, 1976

One prior art approach is disclosed in the patent issued to Sasaki on Sept. 19, 1972 as U.S. Pat. No.

3,693,009. This approach utilizes a single ionization chamber, a pair of spaced electrodes in the chamber, and a grid electrode between the chamber. A potentional is applied between the facing electrodes and a voltage amplifier is connected between the grid and one of the electrodes to detect potential changes. The Sasaki approach utilizes the region between the first electrode and the grid as an internal chamber and the region between the first electrode and the facing electrode as the second external chamber. The Sasaki approach utilizes a direct current battery to bias the two facing plates so that a substantially linear voltage gradient is provided between the facing electrodes. The two facing electrodes are supported appropriately and smoke is directed therebetween upon the event of combustion. The presence of smoke in the external chamber causes a non-linear voltage gradient to exist between the first and second electrodes. The Sasaki device, however, while advantageously eliminating one of the two ionization chambers does not define the chamber response to pressure, temperature and humidity change. If the chamber electrodes are longer than the ion path, an increase in pressure causes an increase in ion collisions with neutral molecules thereby causing increased recombination and less ionization current at the electrodes. This tendency can be compensated by making the collector plate (electrode spacings) shorter than the distance of the ion path. Sasaki simply does not geometrically define the chamber. Furthermore, Sasaki discusses a "space charge limiting effect" due to ion recombination.

In "Ionization Dual-Zone Static Detector Having Single Radioactive Source", U.S. Application Ser. No. 544,818, filed on Jan. 28, 1975, the inventor disclosed an ionization detector also including a single radioactive source having a small volume reference zone and a large volume signal zone set forth in a single ionization chamber. In this approach, a first electrode is preferably unitary in construction with the source of radiation. A second electrode either may be adjacent the walls of the housing or may be formed by the housing itself. A signal electrode is disclosed to extend axially through the axis of the housing disposed above the radioactive source. The reference zone is formed between the signal electrode and the radioactive source while the signal zone is defined by the large space separating the signal electrode and the second electrode or housing. A cylindrical housing is specifically disclosed wherein the height h would correspond to the point of maximum ionization from the point source. While this approach represents a vast improvement over the approach taught by Sasaki, the effect of change in pressures is simply not compensated for.

The importance of pressure, humidity and geometry on the operation of a detector is mathematically analyzed and discussed in "*Ionization-Type Smoke Detectors*", Simon and Rork, Rev.-Sci. Instrum., Vol. 47, No. 1, Jan. 1975, pgs 74–80 and in "Analysis of an Ionization Chamber-Aerosol and Combustion Sensing System", Klein, *Transactions of Instrumentation and Measurement,* Vol. IM-20, No. 1, Feb. 1971, pgs. 33–37.

The following invention is a dramatic improvement over the above prior art improvements as will be discussed and brought out below.

OBJECTS OF THE INVENTION

It is an object of the present invention to provide a new and novel device for detecting particles in a gas.

It is another object of the present invention to provide a new and novel device for detecting particles in a gas of simplified construction, low cost, which is reliable in operation over a wide range of supply voltages.

It is another object of the present invention to provide a new and novel particle detector which is relatively insensitive to pressure, humidity, and temperature, and which does not require extensive calibration.

It is another object of the present invention to provide a particle detector having an electrically charged chamber with a first region of high electric field intensity and low geometric volume and a second region of low electric field intensity and high geometric volume wherein the juncture between the first and second regions occurs at a diffused electric field boundary which is the area in the chamber of maximum electric field change when particles enter the chamber and means cooperative with the diffused electric field boundary for signalling when the electric field change occurs.

It is a further object of the present invention to provide a new and novel particle detector having an electrostatically shielded chamber being a first charged electrode, a second charged electrode cooperative with the first electrode for creating electric field in the chamber, an ion generator effectuating a current between the first and second electrodes, means for directing the particles into the chamber, and a sensor in the chamber responsive to the current reduction between the two electrodes for issuing a signal.

A further object of the present invention is to provide a new and novel particle detector comprising a first charged electrode, a second charged electrode arranged to create an electric field between the first and second electrodes, an ion generator effectuating a current between the first and second electrodes, means for directing particles into the field, and a field-effect transistor having its gate lead disposed in the field between the first and second electrodes so that the source and drain of the transistor are responsive for signalling when the current between the electrodes is reduced.

It is another object of the present invention to provide a new and novel particle detector comprising a voltage source, means operative from said voltage source for producing a first region of a first electric field intensity and low geometric volume and a second region of second electric field intensity and high geometric volume wherein the ratio of the second electric field intensity to the first electric field intensity is substantially less than one, means for generating ions in the electric field, means for directing particles into the field, and a sensor located at the juncture between the first and second region for signalling when particles enter the electric field.

It is another object of the present invention to provide a new and novel particle detector comprising means for producing electric field having a plurality of terminal boundaries, means for generating ions in the electric field, means for directing particles into the electric field, means in the electric field for sensing the maximum electric field change due to the presence of the particles, and a sensor detecting the maximum change for issuing a signal representative thereof.

It is a further object of the present invention to provide a novel particle detector comprising a first charged electrode, means for generating ions being located substantially at the first electrode, a second charged electrode, means for directing particles into the region between the electrodes, means located between the first and second electrodes for sensing the maximum change in the electric field intensity when particles enter the region, and means receptive of the sensed electric field change for issuing a signal.

It is still another object of the present invention to provide a new and novel particle detector having a first charged electrode, means for generating ions, a second charged electrode being located at a predetermined distance from the second electrode wherein the distance is equal to the distance of maximum ion density from the generating means, means for directing particles into the region between the first and second electrodes, means located in the region for sensing electric field intensity change, and means receptive of the sensed change for issuing a signal.

It is still another object of the present invention to provide a new and novel method for detecting particles in a gas including the steps of producing an electric field between first and second electrodes, generating ions in the electric field, directing the gas into the electric field, sensing the electric field intensity in the region of maximum electric field change occurring when the gas contains particles and generating a signal proportional to the change.

SUMMARY OF THE INVENTION

The present invention comprises a low cost, easy to assemble, highly accurate particle detector which uses a single ionization chamber to contain a reference region and a sensing region. The chamber is geometrically designed so that the radioactive source is located near one electrode and the second electrode is located at a distance less than the distance of maximum ionization from the radioactive source.

In one preferred embodiment, a second electrode is a rectangular chamber centrally located over the first electrode which is substantially a point source containing the detector mounted on it. The electric field intensity can be separated into two distinct regions. The first region is termed the sensing region having a high geometric volume and low electric field intensity and a second region termed the reference region having high electric field intensity and low geometric volume. The juncture between the two regions is termed the "diffused electric field boundary" and an unloaded probe is positioned at this juncture to detect changes in the electric field. Since the ion cloud is maximum at the second electrode and since the geometric volume in the sensing region is high and the electric field intensity is low, any particles entering the chamber will effectuate maximum recombination to occur in the sensing region and minimum recombination to occur in the reference region. The diffused electric field boundary is the area of the chamber in which the maximum electric field intensity change will occur upon the entry of the particles. The unloaded probe positioned at this point detects the electric field intensity change and activates a field effect transistor.

The field effect transistor, the radioactive source, and the probe are mounted on the interior of the chamber thereby eliminating the need for separate electrostatic shielding for the field effect transistor and the unloaded probe. Since the outer electrode forms the housing of a chamber, formed ports in the sides of the housing effectively communicate the exterior air into the interior of the chamber. To maintain the electrostatic shielding, deflector shields are arranged on the interior of the chamber behind the formed ports.

The unloaded probe located at the diffused electric field boundary can comprise numerous configurations and shapes, the only requirement being that it does not significantly interfere with the uniform generation of the ions by the radioactive source in the chamber. Furthermore, the geometric shape of the first and second electrodes can also comprise a variety of configurations as hereinafter illustrated.

Other objects, advantages and capabilities of the present invention will become more apparent as the description proceeds taken in conjunction with the accompanying drawings.

DESCRIPTION OF THE DRAWINGS

FIG. 14 is a top planar view illustrating the unloaded probe to be a rectangular grid.

DETAILED DESCRIPTION

Figure 6:
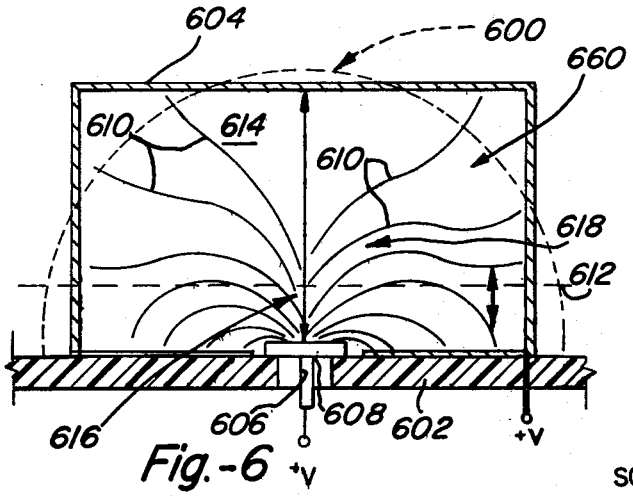
FIG. 6 is a cross-section illustration depicting the formation of the sensing region having a high geometric volume and low field intensity and a reference region having high electric field intensity and low geometric volume.

FIG. 6 illustrates the electric field produced in one of the embodiments of the detector 600 of the present invention. Mounted on an insulated base 602 is a rectangular container 604, the center cross-section of which is shown in FIG. 6. In the center of the rectangular metal container 604 is positioned a metal electrode 606. On top of the metal electrode 606 is a radioactive source 608. The outer metal container 604 is charged to negative voltage while the center circular electrode 606 is charged to a positive voltage, although these polarities may be reversed. An electric field 610 is generated between the circular point source 606 and the outer container or electrode 604. While FIG. 6 illustrates only the cross-section (i.e. two-dimensions) of a three-dimensional electric field, it is clear that due to the specific geometry of the first electrode 606 with respect to the specific geometry of the second electrode 604, a diffused electric field boundary 612 is created. Above the diffused electric field boundary 612 is a region of high geometric volume and low electric field intensity and below is a region of low geometric volume and high electric field intensity.

Figure 5:
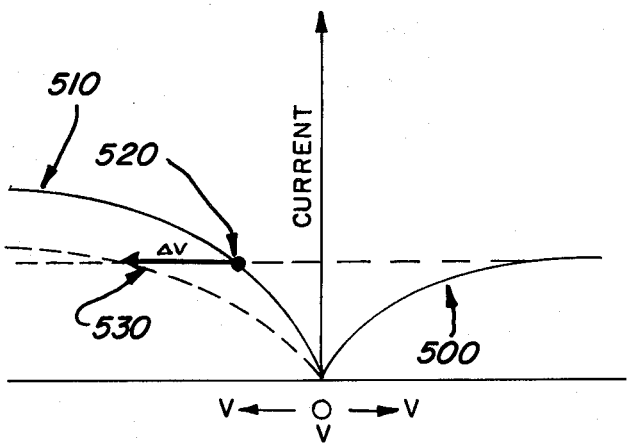
Fig.-5 PRIOR ART
FIG. 5 illustrates the output characteristics of the prior art approach of FIG. 4.

Under the teachings of the present invention, through proper use of the geometry of the first electrode 606 with respect to the second electrode 604 and through proper use of the diffused electric field boundary 612, the single chamber 614 defined on the interior of the container (i.e. first electrode ) 604 can function as a dual chamber ionization detector. As mentioned in FIG. 5, the dual chamber device has a "reference" chamber operating in a saturated condition and a "sensing" chamber operating in a non-saturated state. As between the two chambers (i.e. the reference chamber and the sensing chamber), for purposes of this invention, it is only necessary that the reference chamber be much less sensitive to the presence of particles than the sensing chamber while maintaining stability. It is to be expressly understood that the reference chamber need not be in a saturated condition. In FIG. 6, a reference region in chamber 614, in the direction of arrow 616 can be established in the area between the diffused electric field boundary 612 and the charged radio-active source 608. The reference region has a low geometric volume but high electric field intensity. As mentioned in the above Background of the Prior Art, a region of such low volume and high electric field intensity is insensitive to recombination even in the presence of combustion particles. The ions generated from the source 608 are quickly accelerated to the region of the diffused electric field boundary to present recombination when ion mobility is reduced by ion-particle attachments. However, the region above the diffused electric field boundary 612, as designated by arrow 618, provides a region of low electric field intensity and high geometric volume. This region of a large volume and low electric field intensity is sensitive to ion-particle recombination thereby reducing the ion mobility and recombination. Such a sensing region effectively corresponds to the sensing chamber of a two chamber particle detector. Thus, in FIG. 6 by analysis of the geometry (i.e. volume and relationship of the electrodes) and of the electric field intensity, a single chamber device can function as a dual chamber device.

When particles are directed into the chamber, the location of the diffused electric field boundary 612 changes in a non-linear manner, as will be subsequently discussed.

An unloaded conductive probe located in the boundary area 612 will sense the change in field intensity by producing an output voltage signal upon the entry of particles into the chamber 614. The magnitude of the signal depends upon the following: (1) the location and shape of the probe for optimum coupling with the electric field change from ambient to particle conditions, (2) the size of the chamber 614, (3) the geometry of the chamber 614, (4) the magnitude of the charge on electrodes 604 and 606 to shape the electric field 610 for an optimum field change upon the entry of particles and (4) the energy of the radioactive source in generating ions.

Figure 7:
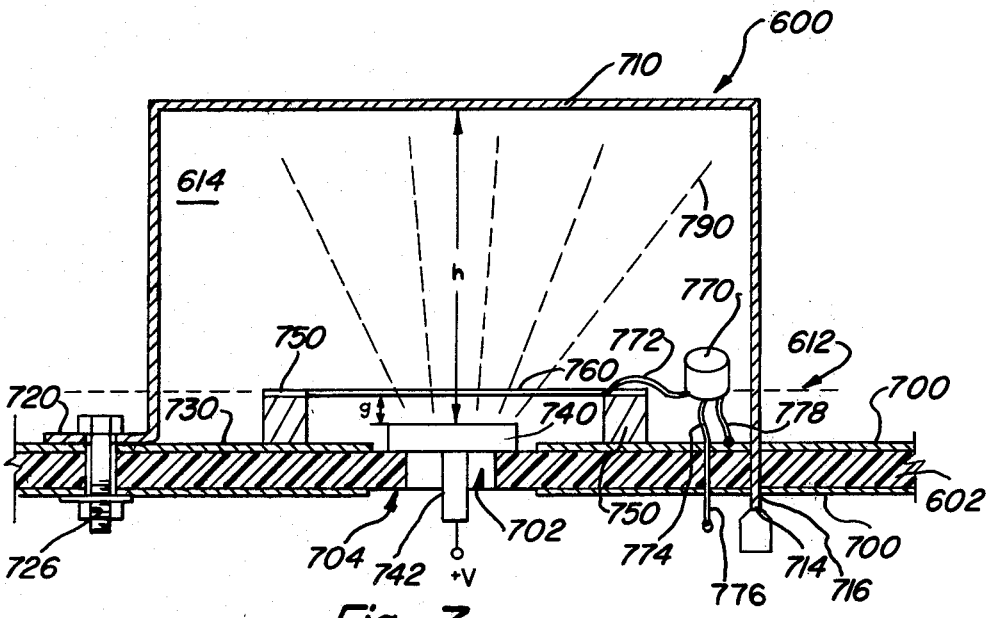
FIG. 7 is a cross-sectional side view of one embodiment of the detector of the present invention.
Figure 9:
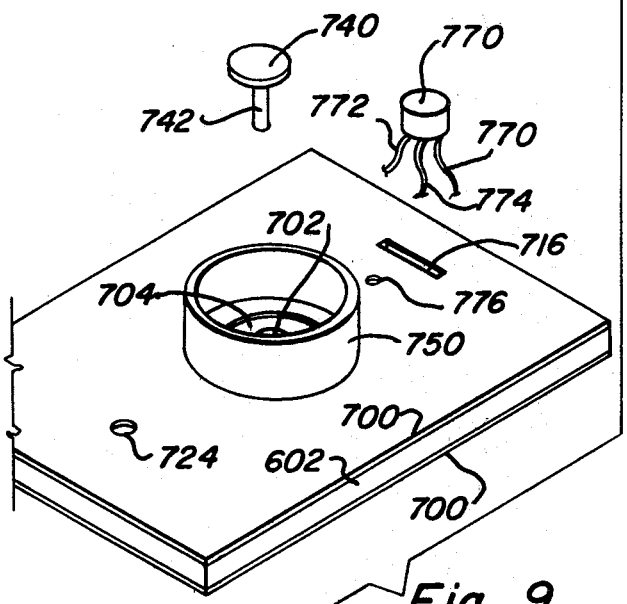
FIG. 9 is an exploded perspective view of the components of the detector shown in FIG. 7.

In FIG. 7 is shown the cross-section of one preferred embodiment of the particle detector 600 of the present invention. An insulating base or platform 602 is provided with conductive printed circuit material 700 such as copper. The insulating platform 602 has a circularly cut hole 702 and the printed circuit material 700 is not deposited in the circular lip region 704 around the hole 702. As shown in FIG. 9, the platform 602 is rectangular in shape and the printed circuit material 700 is substantially deposited over the entire outer surfaces of the insulating material 602 by conventional techniques. However, the circular lip region 704 around the formed hole 702 is free of the printed circuit material 700.

An outer container 710 is formed, conventionally, from metal or similar conducting material to have an overall appearance as shown in FIG. 9. The container 710 is substantially rectangular in shape having an open bottom end 712. The container 710 is affixed to the platform 602 by means of a twist tab protrusion 714 extending down from one end of the container 710 through a formed slot 716 formed through the printed circuit material 700 and the platform 602. As shown in FIG. 7, this twist tab 714 upon insertion through the formed slot 716 can be twisted to firmly affix the container 710 to the board assembly 602. Opposite the end having the twist tab 714 is a right angle tab 720 having formed therethrough a hole 722. The formed hole 722 aligns itself with a correspondingly formed hole 724 formed in the platform 602 so that when the container is in the position as shown in FIG. 7 and the twist tab 714 has been twisted to an affixed position, the hole 722 and 724 align so that the container 710 can be conventionally affixed to the platform 602 by a conventional means such as a screw and bolt assembly 726 as shown in FIG. 7. In this manner, chamber 614 is formed by the upper container 710 and a portion of the printed circuit material 700 designated as 730.

As further shown in FIGS. 7 and 9, a radioactive source 740 is affixed to a metal plug 742 by conventional means. The radioactive source 740 is mounted in a metallic foil so that the connection of the plug 742 to the radioactive source 740 makes the foil of the source 740 electrically conductive with the plug 742. The bottom surface of the radioactive source 740 is mounted to the circular lip region 704 of the insulating material 602. The plug 742 is, therefore, insulated from the printed circuit material 700. The radioactive source 740 is conventional and may be radium 266 Americium 241 with an alpha energy of 4.7 Mev. Other alpha energies may be used with a different sized outside electrode.

As shown in FIGS. 7 and 9, a cylindrically shaped annular support 750 is mounted around the circularly formed hole 702 on the interior of the chamber 614 conventionally fastened or affixed to the printed circuit material 700 on the platform 602. As shown in FIG. 9, a narrow rod-shaped conductive probe 760 is conventionally attached on the upper surface of the insulating support 750 and aligned to orient directly across the source 740. Attached at one end is a field-effect transistor 770 having its gate lead 772 attached to the probe 760 with its source lead 774 insulated and directed through a formed hole 776 in the printed circuit material 700 and the platform 602. Furthermore, the drain lead 778 is interconnected with the printed circuit material 700.

The conductive probe 760 is unloaded (i.e. not connected to a voltage source) and is positioned in the area of the diffused electric field boundary 612. The probe 760 is oriented and located in the diffused electric field boundary for maximum coupling therewith. The region between the probe 760 and the radioactive source 740 defines the "reference" region of high electric field intensity and low geometric volume. The region between the probe 760 and the container 710 and surface 730 defines the "sensing" region of high geometric volume and low electric field intensity.

Figure 1:
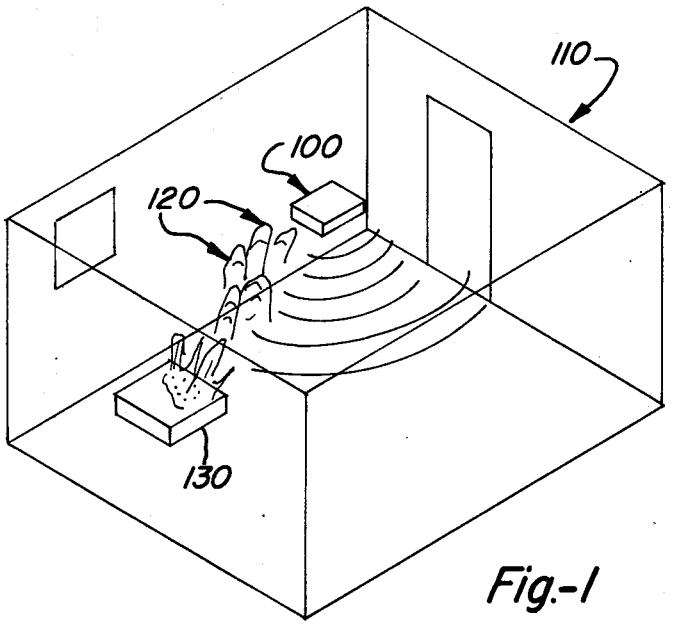
FIG. 1 is a diagrammatic illustration of a particle detector in a room filled with smoke.
Figure 2:
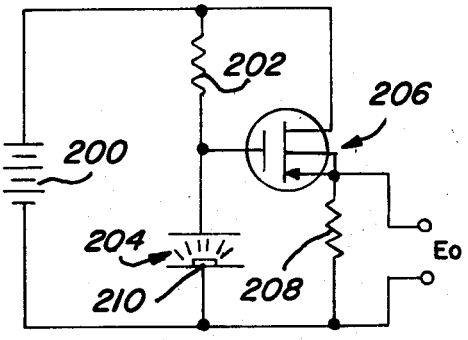
Fig.-2 PRIOR ART
FIG. 2 is a schematic diagram of a single chamber prior art ionization detector.
Figure 3:
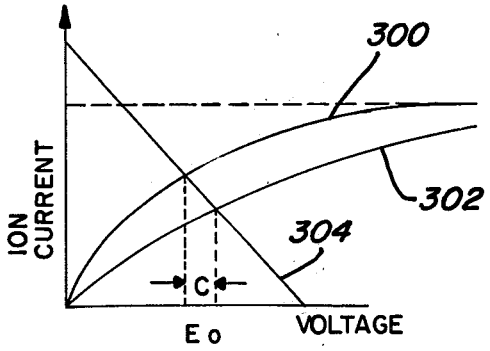
Fig.-3 PRIOR ART
FIG. 3 is the output characteristic of the ionization detector of FIG. 2.
Figure 4:
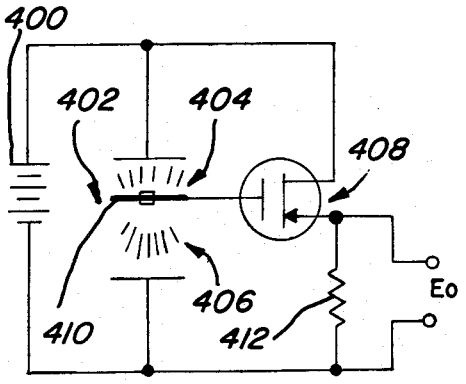
Fig.-4 PRIOR ART
FIG. 4 is a schematic diagram of a dual chamber prior art ionization detector.

In operation, the metal plug 742 is connected to positive voltage and the printed circuit conductive material 700 is connected to negative voltage. An electric field 610 is established in the chamber 614 as shown in FIG. 6. The probe 760 is unloaded and is positioned in the area of the diffused electric field boundary 612 (i.e. the area of maximum electric field intensity change upon the entry of particles into chamber 614). The source and drain of the field-effect transistor 770 is conventionally interconnected as, for example, shown in FIG. 4. The gate 772 of the field-effect transistor 770 is interconnected directly to probe 760. Any particles directed into the chamber by means of ports 780 formed around the periphery of the container 710, causes the electric field to change substantially. This change is detected by gate lead 772 of the field-effect transistor 770 and is amplified to produce an output voltage indication as will be discussed later in greater detail. The field-effect transistor 770 also should be high quality and conventionally be of the type manufactured by Siliconix, Motorola, General Instruments, and Intersil, not having a gate leakage of more than about $10^{-12}$ amps.

Figure 8:
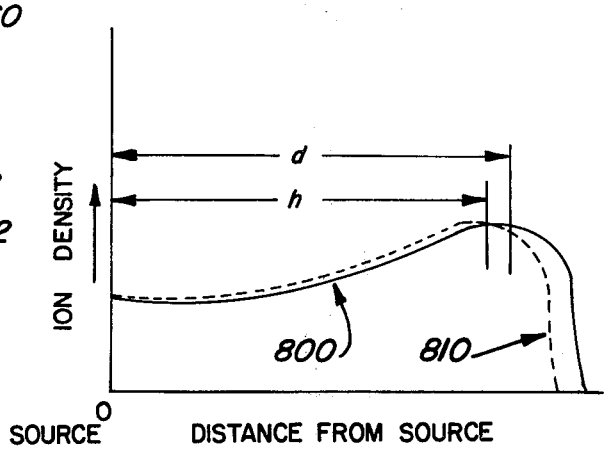
FIG. 8 graphically depicts the Bragg ionization peak of a radioactive source.

The radioactive source 740 uniformly provides particle emissions as represented by dotted lines 790. The alpha particle emission 790 effectuates ionization as shown in FIG. 8 and as represented by curve 800. The ion density achieves a peak at a given distance, d, from the source. For purposes of the specification, the curve 800 is termed the Bragg Curve and the peak is termed the Bragg Peak. As shown in FIG. 6, the Bragg Peak 600 is designed to occur just outside the side walls of the container 710, the walls are, therefore, located at a predetermined distance h from the radioactive source 740 where h is less than d. For environmental compensation, the electrode wall is incident with the left side of the Bragg Curve peak. The wall is located to be within the peak proper but just under the location of maximum ionization. When temperature, pressure, or humidity increases, the Bragg Curve shifts as indicated by curve 810. Such a shift actually increases sensitivity contrary to prior art approaches.

The probe 760 is designed to provide, as mentioned, maximum coupling with the maximum field intensity change when the chamber 614 contains particles. This is determined by experimentation and is termed gap distance g from the source 740. The probe 760 is designed to obstruct as little alpha particle emission from the source 740 as is possible yet maintaining the above mentioned coupling.

The following advantages over the above prior art systems are seen in the above disclosed approach: (1) simplicity, (2) low production costs, (3) a platform 602 serves as one chamber wall and provides for convenient installation of the field-effect transistor 770, the radioactive source 740, the insulating posts 750, and the probe 760, (4) greater reliability is apparent since no close tolerances are required of any parts as is required for dual chamber construction, including the radioactive source, (5) both the sensing and reference regions are open to ventilation preventing the problem of trapped moisture in the separate reference chamber of the prior art devices that often causes false alarms, (6) the detector can operate over a wide range of supply voltage without making conventional changes, since the ratio of field intensity in the two regions is the same — the supply, for example, can vary between 5 and 20 volts D.C., (7) the housing 710 provides internal electrostatic shielding to protect the field effect transistor 770, the source 704, and the probe 760 — no additional compartments, usually found in conventional prior art approaches, are necessary, (8) no radioactive source 740 selection is required — the source activity can vary more than a radio of 20 to 1 without changing the detector performance, (9) no internal adjustments are necessary making production calibration extremely simple, and (10) source contamination is extremely tolerant since ion current reduction caused by source contamination changes the ratio of ion current in both the reference and sensor regions resulting in little change in operating point.

The distance between the printed circuit conductive material 700 and the outer circumference of the radioactive source 740 is typically 0.15 to 0.20 inches. The insulating support 750 may comprise any conventional configuration and may be, for example, two opposing upstanding cylindrical posts.

Figure 10:
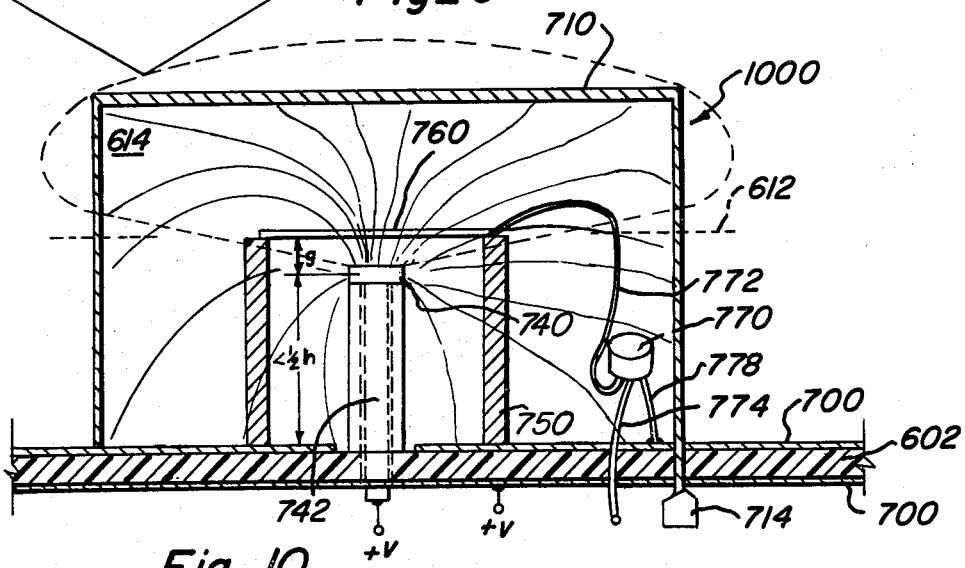
FIG. 10 is a side cross-sectional view of one embodiment of the detector of the present invention.

In FIG. 10 is shown a second preferred embodiment 1000 of the detector of the present invention to provide a substantially hemispherical electric field 1000. In this embodiment, the housing electrode 710 corresponds substantially to that shown in FIG. 7. The corresponding parts of FIG. 7 are indicated in FIG. 10 and will not be further described. The major distinction between the embodiment shown in FIG. 7 and that shown in FIG. 10 is the provision that the radio-active source 740 is elevated to a position one-half or less the height h of the housing of 710. Such elevation permits a greater gap g to be obtained than in the approach shown in FIG. 7. Typically, the probe is elevated 0.4 to 0.5 inches from the platform 602 with a housing height of 0.8 to 1.2 inches. The gap width g is typically 0.05 to 0.3 inches. Such an arrangement reduces possible false alarms from moisture or contamination from the airborne or production sources on the insulating post. The sensitivity of configuration is more tolerant of geometry and more sensitive to the presence of smoke than the embodiment shown in FIG. 7. Since ions are generated in a hemisphere, the Bragg Peak is designed to be located outside the walls so that the relation of $h<1$ is maintained. For the elevated source, the printed circuit board plane 700 may be either V− or V+ as is the source, because the elective field lines below the source have little effect in the important reference chamber diffused volume. This provides two desirable features over FIGS. 6 & 7: (1) Broadening and rounding of the electric field above the source eliminates critical positioning of the probe, and (2) Independence from the printed circuit board V− or V+ plane eliminates tolerance variations of the source and probe assembly caused by mechanical and thermal influences.

Figure 11:
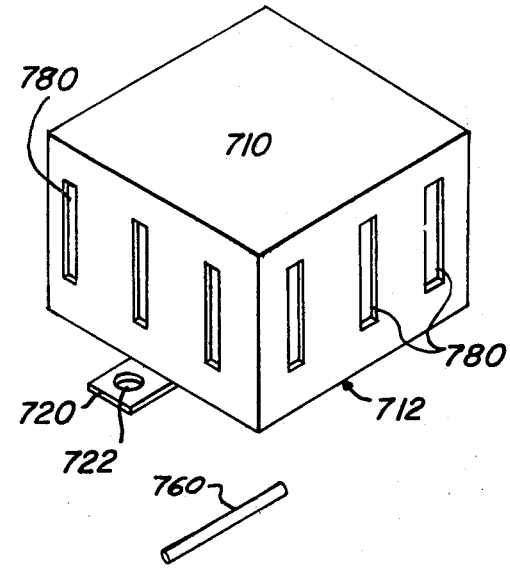
FIG. 11 is a side cross-sectional view of a third embodiment of the detector of the present invention.
Figure 11:
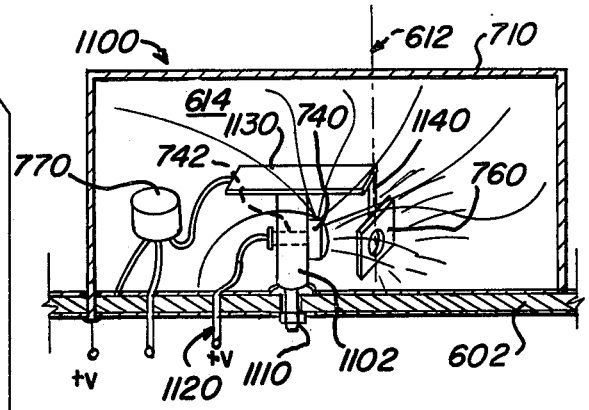

Yet another embodiment 1100 is shown in FIG. 11 wherein the probe 760 is mounted vertically in the chamber 614. In this embodiment, a mounting stand 1102 is provided which is conventionally attached to the platform 602 by means of a screw or the like 1110. The radioactive source 740 is mounted on the side of the support 1102 and the metal plug 742 is mounted through support 1102 and is interconnected to the insulated wire 1120 on the underside of the platform 602. Atop the stand 1102 is an insulating strip 1130 one end of which is connected to the field-effect transistor 770 and the other end of which is connected to a vertical flange 1140 which is connected to the vertically oriented probe 760. Once again, the probe 760 is aligned in the plane of the diffused electric field boundary 612.

Figure 12:
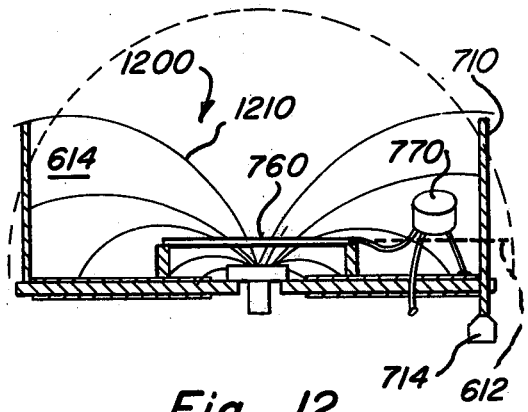
FIG. 12 is a side cross-sectional view of a fourth embodiment of the particle detector of the present invention.

Another embodiment 1200 of the detector of the present invention is shown in FIG. 12 wherein the top of the container 710 is removed. In this embodiment, the electric field lines are shown as 1210 and the diffused electric field boundary is shown as 612. The probe 760 is in the plane parallel with 612 and the particles can be directly inputted into the chamber 614 through the top. Of course, no electrostatic shielding for the field-effect transistor 770 is provided in this embodiment. In all other respects, the embodiment shown in FIG. 12 is the same as that shown in FIG. 7.

Figure 13:
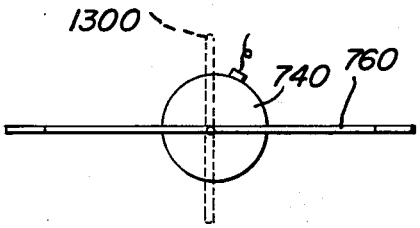
FIG. 13 is a top planar view illustrating the unloaded probe to be a cylindrical or flat rod or cross-bar.

Various probe configurations are shown in FIGS. 13–17. In FIG. 13 the probe 760 is shown to be a thin rod which may be conventionally manufactured from conductive wire or ribbon. The diameter of the rod may vary from 0.01 inches to 0.1 inches which is sufficient not to block out a significant amount of the emitted alpha particles from source 740. The length of the rod, at the minimum, must reach just across the diameter of the source 740 and the maximum length, of course, would be just under the length of chamber 614. An additional portion of rod 1300 may be added, as shown by the dotted lines, perpendicular to the first rod to form a cross-bar probe.

Figure 14:
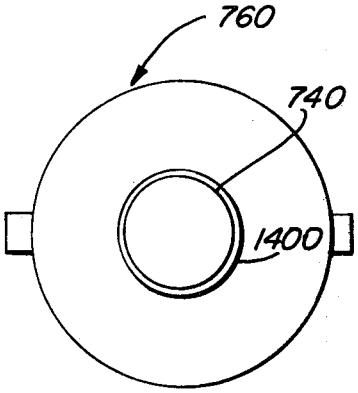
FIG. 14 is a top planar view illustrating the unloaded probe to be a circular disc.

In FIG. 14 is shown yet another embodiment of the probe 760 to contain a circular metallic disc or square having an inner circular hole 1400 formed therein so that the generation of the ions is not blocked. The inside diameter is typically 0.2 to 0.5 inches while the outside diameter is typically 0.8 to 1 inch in diameter.

Figure 15:
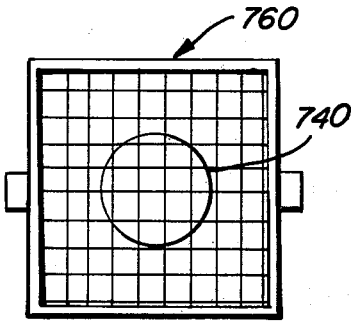

In FIG. 15 is shown a probe 760 which may be either a square or circular mesh. The mesh is typically 0.1 inch to 0.2 inch squares with a total size of 0.8 to 1.0 inches on one side.

Figure 16:
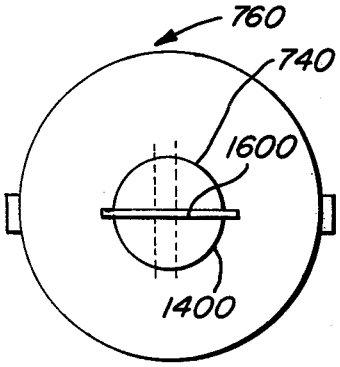
FIG. 16 is a top planar view illustrating the unloaded probe to be a combination of the rod or cross-bar of FIG. 13 and the disc of FIG. 14.

In FIG. 16, is shown the circular disc of FIG. 14 having a rod 1600 disposed across the circularly formed hole 1400. The dimensions are the same as those shown in FIGS. 13 and 14.

Figure 17:
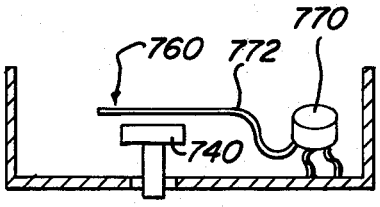
FIG. 17 is a side sectional view illustrating the gate lead of the field-effect transistor to be the unloaded probe.

Indeed, as shown in FIG. 17, the field-effect transistor 770 can use its gate lead 772 as the probe 760. Such an approach eliminates miscellaneous leakage paths and is the ultimate approach in component reduction. The above examples of probe geometry are intended to be representative and are not intended to limit or delimit the scope of this invention. Many other probe geometrics can be contrived and yet would still fall under the teachings of the present invention.

Figure 18:
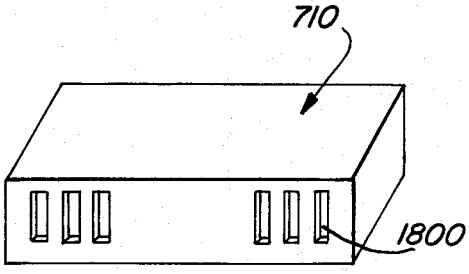
FIG. 18 is a perspective view of the formed ports in the housing of the detector of the present invention.

The container 710 also serves as the exterior housing portion of the detector of the present invention as shown in FIG. 18. Air or gas entry is important for reliable particle detection. However, the gas entry must be made such that adequate electrostatic protection with the internal chamber probe and field-effect transistor are maintained. Under the teachings of this invention, if the sensitive internal components cannot be visually seen from the exterior of the housing, then the components have reasonable electrostatic shielding.

Figure 19:
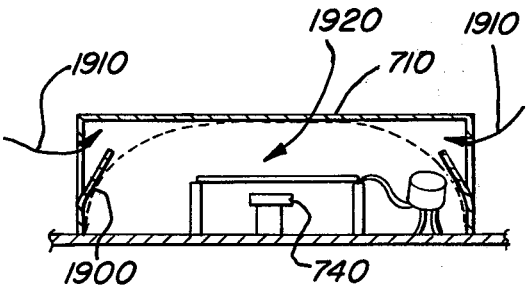
FIG. 19 is a side sectional view illustrating the interior deflector shields behind the ports of FIG. 18.

In FIG. 18, ports 1800 are provided in the side of the container 710. As shown in FIG. 19, these ports have pushedin cutaways or deflector shields 1900 which allow the incoming gas 1910 to be pushed to the top of the container 710. The incoming gas 1910 with particles, if any, is thoroughly mixed in the sensing region 1920 of the detector, yet, total electrostatic shielding of the internal components is maintained. These ports are typically 0.02 to 0.03 inches wide and 0.5 to 1.5 inches long.

The field-effect transistor 770 being exposed to gas 1910 can absorb residual moisture which may result in dangerous moisture creep into the transistor 770 along its leads thereby reducing its resistance. A potting material can be used to prevent such leakage. One such suitable material is transparent one-part silicon elastoplastic-moisture cure. A coating of this material over the transistor 770 absorbs the residual moisture and seals the outer surface of the transistor. This coating is flexible enough so that installation of the field-effect transistor 770 does not cause cracks therein. The coating actually cures with humidity and moisture and, therefore, substantially prevents moisture creep. None of the known prior art approaches provides such protection for the field-effect transistor 770.

Figure 20:
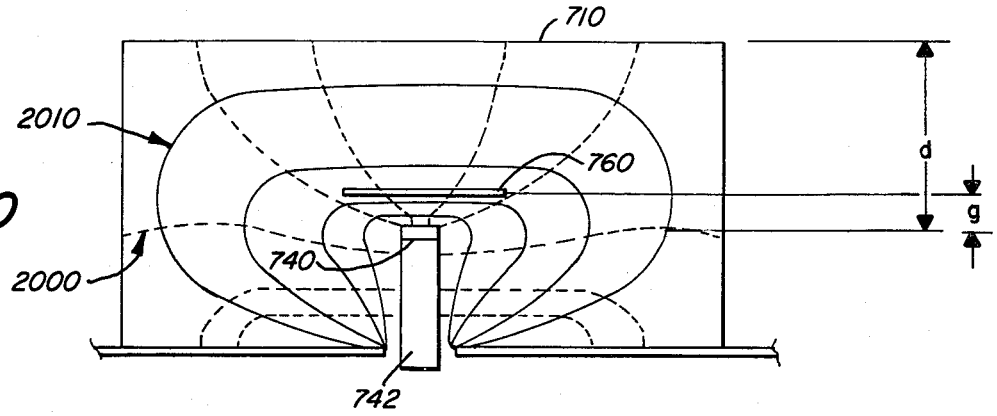
FIG. 20 is a diagrammatic illustration of the field distribution of the detector as shown in FIG. 10 under no smoke conditions.

In FIG. 20, is shown the field distribution of the embodiment 1000 shown in FIG. 10. The field distribution showing the electric field lines 2000 and the hemispherical equipotentials 2010 are those shown for the condition of no smoke. The probe 760 is located g distance above the source 740. In this embodiment, the outer electrode 710 is charged to 0 volts and the inner electrode 742 is charged to ±15 volt D.C. The gradient of voltage is shown in FIG. 20. Note the 12 volt potential and the 9 volt potential are close to the radioactive source 740. The probe 760 is located in the region of 7–8 volts and the remaining voltage is distributed in a "sensing" area of the chamber.

Figure 21:
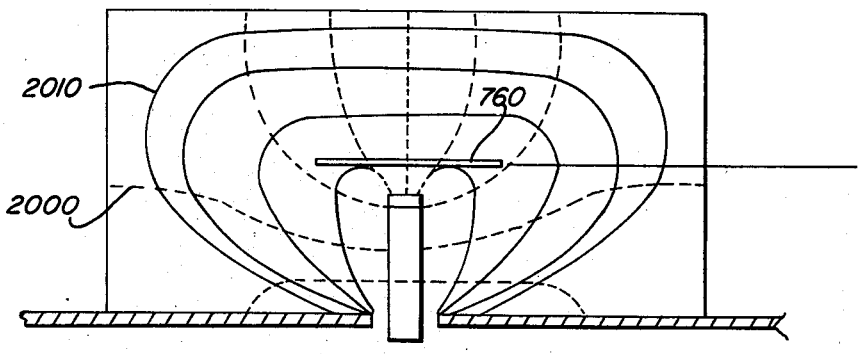
FIG. 21 is a diagrammatic illustration of the field distribution of the detector of FIG. 10 when smoke is present.
Figure 22:
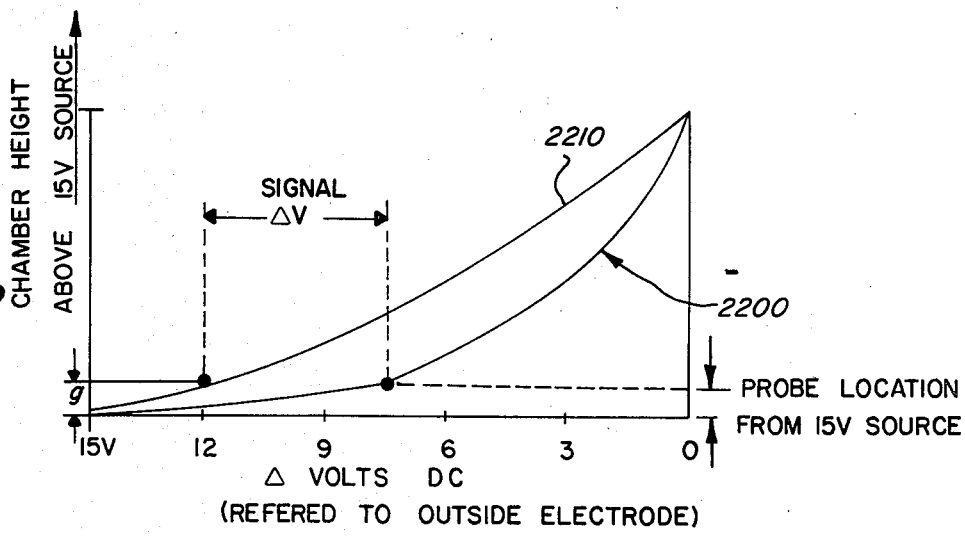
FIG. 22 illustrates the output characteristics of the device of FIG. 10 under smoke and no smoke conditions.

Upon the advent of smoke, the field distribution changes to that shown in FIG. 21. The response curve for the ionization chamber 1000 is shown in FIG. 22 to reflect the conditions shown in FIGS. 20 and 21. Curve 2200 is the output response curve of the ionization detector before smoke as shown in FIG. 20, whereas curve 2210 is the output response curve for smoke of the ionization chamber as shown in FIG. 21. The change in voltage experienced on the probe 760 is shown to be 5–6 volts. It is to be understood that the probe, in this example, is located at the position of maximum voltage change upon the entrance of smoke into the chamber. The probe, however, could be located in any region of large voltage swing which is physically convenient from the source 740 and is easy to manufacture — to do so, however, would reduce the sensitivity of the device.

Figure 23:
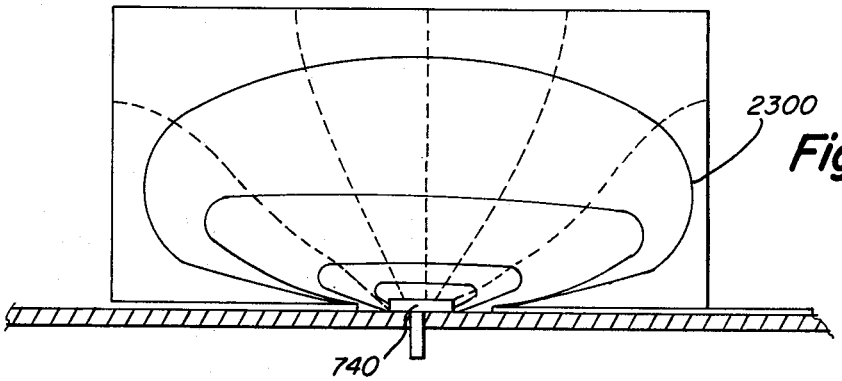
FIG. 23 is a diagrammatic illustration of the field distribution of the device shown in FIG. 7.

In FIG. 23, is shown the field distribution of the embodiment 600 shown in FIG. 7. In this embodiment, the equipotential lines 2300 are closely concentrated in the region above the radioactive source 740. In this approach, the manufacturing tolerances of the various components become more significant whereas in the embodiment shown in FIG. 10, the manufacturing tolerances of the parts are less critical. Both approaches, however, result in practical operative devices.

Figure 24:
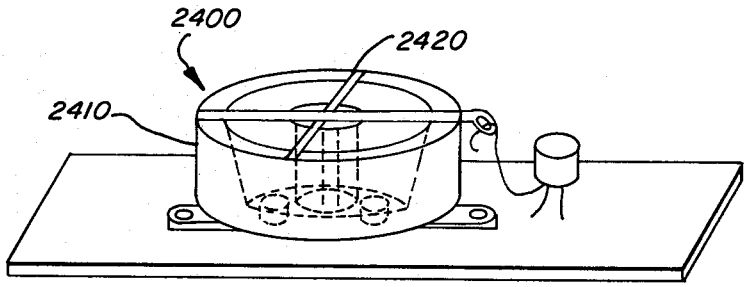
FIG. 24 is a partial perspective view of one embodiment of the ionization detector of the present invention.
Figure 25:
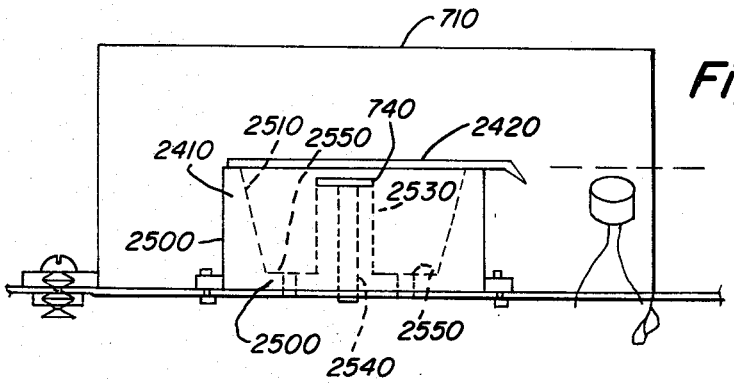
FIG. 25 is a cross-sectional view of the detector shown in FIG. 24.

A final embodiment 2400 is shown in FIGS. 24 and 25. In this embodiment, a one-piece insulating probe support 2410 is used to support a cross-bar probe 2420. The support 2410 is of one-piece construction and, as shown in FIG. 25, has substantially cylindrically shaped outer walls 2500 with inwardly tapering inward walls 2510. The inward walls 2510 terminate in a bottom wall 2520. The arrangement of the bottom wall 2520, the inwardly tapering inner walls 2510 and the outer wall 2500 serve to form an annular cup-like support. Centrally disposed on the inside of the probe support 2410 is a cylindrically upstanding support 2530. The height of the inward upstanding support 2530 is such that when the radioactive source 740 is pressfitted into a formed cylindrical passageway 2540, the distance from the upper surface of the radioactive source 740 to the upper electrode 710 is h. The height of the outer wall 2500 of the probe 2410 is such that when the cross-bar probe 2420 is press-fitted into the support 2410, or otherwise affixed, the distance from the probe 2420 to the upper surface of the radioactive source 740 is g. Disposed around the upstanding column 2530 are a plurality of drain holes 2550 formed through the bottom wall 2520 to correspond to formed holes in support base 602. In this manner, any water or fluid accumulation can be rapidly disposed of. The embodiment 2400 shown in FIGS. 24 and 25 results in a low cost, easily manufactured structure. A minimum number of parts is utilized.

Although the present invention has been described with a certain degree of particularity, it is understood that the present disclosure has been made by way of example and that changes in details of structure may be made without departing from the spirit thereof.

I claim:

1. An ionization detector for indicating the presence of particles comprising:

an electrically charged chamber having an electrically conductive side wall surrounding said chamber and electrically conductive opposite end walls, means for generating ions in said chamber, said ion generating means being within said chamber and spaced from said electrically conductive end walls, said electrically charged chamber comprising:

(1) a first region of high electric field intensity and low volume, and (2) a second region of low electric field intensity and high volume, the juncture between said first and second regions occurring at a diffused electric field boundary, said diffused electric field boundary being the area in said chamber of maximum electric field change when said particles enter said chamber, and means cooperative with said diffused electric field boundary for generating a signal indicative of said electric field change.

2. The detector of claim 1 wherein said signal generating means includes a probe within said chamber between one of said electrically conductive end walls and said ion generating means.

3. A particle detector comprising:

a first charged electrode, means for generating ions, a second charged electrode, said second electrode including a chamber formed by an electrically conductive side wall and electrically conductive opposite end walls, said walls of said chamber being positioned at a predetermined distance from said ion generating means and within said chamber, said distance being less than the distance of maximum ion density from said generating means, means for directing particles into the region between said first and second electrodes, means located in said region for sensing the change in electric field intensity, and means receptive of said sensed electric field change for generating a signal indicative of said field change.

4. The detector of claim 3 in which said first charged electrode is substantially a point source in said chamber, said first electrode being insulated from said second electrode.

5. The detector of claim 3 in which said first charged electrode is contiguous to said ion generating means within said chamber and in which said sensing means is an uncharged electric field probe, said probe being capable of substantially allowing said ion generating means on said first electrode to generate ions in the region between said probe and said second electrode.

6. A particle detector comprising:

a first electrode, a second electrode, said second electrode forming the walls of a chamber, said walls including an electrically conductive side wall and electrically conductive opposite end walls, said first electrode being positioned in said chamber and spaced from said opposite end walls, means for uniformly generating ions, said generating means being located near said first electrode and in said chamber, means for forming an electric field between said first and said second electrodes, means cooperative with said walls of said chamber for directing particles into said chamber, means positioned in the diffused electric field boundary for sensing changes in the intensity of said electric field, said electric field boundary being the area in said chamber of maximum electric field change when said particles enter said chamber, and means responsive to said sensed field change for indicating when said particles enter said chamber.

7. The detector of claim 6 in which said sensing means is an uncharged electric field probe, said probe being capable of substantially allowing said generating means on said first electrode to generate ions in the region between said probe and said second electrode.

8. A particle detector comprising:

an electrically conductive chamber having electrically conductive walls defining said chamber, an electrode disposed within said chamber and spaced from said walls thereof, means interconnected with said chamber and said electrode for generating an electric field between said chamber and said electrode, means contiguous to said electrode for generating ions in said chamber, and means in said electric field within said chamber for sensing changes in said electric field intensity when particles are present in said chamber.

9. The particle detector of claim 8 in which said ion generating means and said electrode comprise a conductive disc containing a radioactive source.

10. The particle detector of claim 9 in which said sensing means is an unloaded conductive probe, said probe being disposed above said electrode.

11. The particle detector of claim 10 in which said probe is a thin rod, said rod being positioned over said electrode.

12. The particle detector of claim 11 in which said probe further has a cross-rod perpendicular to said thin rod, said cross-rod being positioned over said electrode.

13. The particle detector of claim 10 further comprising an insulating support for positioning said probe over said electrode, said electrode being between said probe and said wall of said chamber.

14. The particle detector of claim 10 wherein said probe includes a circular conductive washer.

15. The particle detector of claim 8 in which said electrode is disposed near the center of said chamber.

* * * * *